US007625606B2

(12) United States Patent
Kakihara et al.

(10) Patent No.: US 7,625,606 B2
(45) Date of Patent: Dec. 1, 2009

(54) RESIN PLATING METHOD WITH ADDED HEAT-TREATING PROCESS

(75) Inventors: Kunihiro Kakihara, Fukuyama (JP); Yoshinori Noda, Fukuyama (JP)

(73) Assignee: Kakihara Kogyo Co., Ltd., Fukuyama-shi (JP)

( * ) Notice: Subject to any disclaimer, the term of this patent is extended or adjusted under 35 U.S.C. 154(b) by 680 days.

(21) Appl. No.: 10/561,966

(22) PCT Filed: May 11, 2005

(86) PCT No.: PCT/JP2005/008588

§ 371 (c)(1), (2), (4) Date: Dec. 22, 2005

(87) PCT Pub. No.: WO2006/120733

PCT Pub. Date: Nov. 16, 2006

(65) Prior Publication Data

US 2007/0099418 A1 May 3, 2007

(51) Int. Cl.
*H01L 21/47* (2006.01)

(52) U.S. Cl. ..... 427/316

(58) Field of Classification Search ..... 427/316
See application file for complete search history.

(56) References Cited

U.S. PATENT DOCUMENTS 4,940,608 A * 7/1990 Kawagishi et al. ..... 427/259

FOREIGN PATENT DOCUMENTS

| | | | |
|---|---|---|---|
| JP | 0125675 | * 10/1989 | ..... 427/140 |
| JP | 7-118416 | 5/1995 | |
| JP | 2004-300566 | 10/2004 | |

* cited by examiner

*Primary Examiner*—Timothy H Meeks
*Assistant Examiner*—Nathan T Leong
(74) *Attorney, Agent, or Firm*—Edwards Angell Palmer & Dodge LLP

(57) ABSTRACT

A resin plating method for a resin molding is disclosed which involves a simple process as an additional process in resin plating to suppress the occurrence of such an undesirable phenomenon as a metal plating film peeling together with a thin resin film due to floating of a thin surface film of the resin molding. A specific portion of the resin molding which portion is apt to undergo peeling of a thin surface resin film is heat-treated at a high temperature and thereafter resin plating is performed.

2 Claims, 7 Drawing Sheets

(a)

(b)

1st Measurement

| | Temperature (° C) | | | | | |
|---|---|---|---|---|---|---|
| Treating Conditions | 1 | 2 | 3 | 4 | 5 | 6 |
| ① | | | 102.5 | 124 | 144.2 | 171 |
| ② | | | 90.8 | 107 | 111.1 | 118.5 |
| ③ | | | 97.9 | 117.2 | 138.8 | 153.6 |
| ④ | | | 89.2 | 111.4 | 130.8 | 151 |
| ⑤(Indoor) | | | 22.2 | 22.2 | 22.2 | 22.2 |

(c)

2nd Measurement

| | Temperature (° C) | | | | | |
|---|---|---|---|---|---|---|
| Treating Conditions | 1 | 2 | 3 | 4 | 5 | 6 |
| ① | 42.3 | 51.3 | 85.5 | 134.1 | 143.7 | 168.6 |
| ② | 64.5 | 80.6 | 99.1 | 106.3 | 111.8 | 130.2 |
| ③ | 50.4 | 60.9 | 83.1 | 119.9 | 128.4 | 153.2 |
| ④ | 70.7 | 86.2 | 105.3 | 116 | 129.7 | 159.1 |
| ⑤(Indoor) | 22.3 | 22.4 | 22.7 | 22.8 | 22.5 | 22.4 |

Fig.3

| Material Conditions | Plated Part | Sample No. | Number of Cycles of Hot-Cold Shock Test | | | | | |
|---|---|---|---|---|---|---|---|---|
| | | | 10 | 20 | 50 | 100 | 150 | 200 |
| Without heat treatment | A | 1 | O | O | O | × | — | — |
| | | 2 | × | — | — | — | — | — |
| | | 3 | × | — | — | — | — | — |
| | | 4 | O | × | — | — | — | — |
| | | 5 | O | O | × | — | — | — |
| | B | 1 | O | O | × | — | — | — |
| | | 2 | O | O | × | — | — | — |
| | | 3 | O | O | × | — | — | — |
| | | 4 | O | O | O | O | × | — |
| | | 5 | O | O | O | × | — | — |
| | C | 1 | O | × | — | — | — | — |
| | | 2 | O | × | — | — | — | — |
| | | 3 | O | O | × | — | — | — |
| | | 4 | O | O | × | — | — | — |
| | | 5 | O | × | — | — | — | — |
| Heat-treated | A | 1 | O | O | O | O | O | O |
| | | 2 | O | O | O | O | O | O |
| | | 3 | O | O | O | O | O | O |
| | | 4 | O | O | O | O | O | O |
| | | 5 | O | O | O | O | O | O |
| | B | 1 | O | O | O | O | O | O |
| | | 2 | O | O | O | O | O | O |
| | | 3 | O | O | O | O | O | O |
| | | 4 | O | O | O | O | O | O |
| | | 5 | O | O | O | O | O | O |
| | C | 1 | O | O | O | O | O | O |
| | | 2 | O | O | O | O | O | O |
| | | 3 | O | O | O | O | O | O |
| | | 4 | O | O | O | O | O | O |
| | | 5 | O | O | O | O | O | O |

[Evaluation] O : free of blister × : blister

Air bottle type thermal shock tester

Test Conditions: 80℃/30min → −30℃/30min as one as one cycle, the appearance of product is checked after the end of a predetermined number of cycles.

RESIN PLATING METHOD WITH ADDED HEAT-TREATING PROCESS

TECHNICAL FIELD

The present invention relates to a resin plating technique for applying metal plating to a resin molding. Particularly, the present invention is concerned with a resin plating method involving a heat-treating process as an additional process able to prevent the occurrence of a plating floating phenomenon caused by peeling of a thin surface film of a molding material which occurs particularly in resin-plated products.

BACKGROUND ART

Resin-plated products treated by various resin plating methods have heretofore been proposed. On the other hand, the number of accidents is increasing with respect to resin-plated products available on the market. For example, accidents have occurred in the case of resin-plated products which are frequently handled directly by hand such as products used as substitutes for washing metal fittings, e.g., faucets and shower parts in bathrooms, and automobile parts, e.g., radiator grille, door opening/closing handles and interior decorative parts. In these resin-plated products there has occurred an injury accident such that a resin-plated film floats and a hand is cut by the resulting sharp portion.

For example, in the case of an automobile indoor handle formed by molding with use of PC/ABS resin, a so-called "blister" may occur from a parting portion of a resin-plated product, as shown in FIGS. 6 and 7 which are enlarged photographs of sections of resin-plated products. The blistered portion of the resin-plated product is in a floated state of a plating film as indicated by an arrow in FIG. 6. For example, when the resin-plated product is peeled with an acid, ply separation of a thin film occurs in the blister portion and at the same time the plating film assumes a floating state.

As shown in FIG. 7, the ply separation of a thin film of the resin-plated product may occur also in a resin molding which incorporates a resin apt to form a layered structure during molding such as PP resin or incorporates a different kind of incompatible resin. This was confirmed when such a thermal shock test or thermal cycle test as will be described later was performed for resin-plated products using PC/ABS (polycarbonate/ABS) resin or ABS resin. When viewed from the standpoint of molding conditions for resin moldings, the phenomenon in question tends to occur more frequently when the injection speed is high or when there evolves much gas of a low-boiling fraction. The state of occurrence of the phenomenon in question also differs depending on the product shape or the mold structure.

FIGS. 8 to 10 are photographs of a resin surface of a resin molding taken through a transmission electron microscope (TEM).

With respect to a resin molding obtained under the same conditions as those adopted for a product which underwent ply separation when there was conducted such a strong thermal shock test as illustrated, the present inventor checked a state of deformation of the resin surface with use of photographs taken through a transmission electron microscope (TEM).

FIG. 8 is a photograph showing the state of a cavity surface (a front surface) of a resin molding. In the same figure, a circular or black dot-like portion represents a rubber component contained in resin. In this resin molding, the rubber component is uniformly dispersed in a circular shape in the resin surface of the cavity surface and a molding stress in the resin surface is reduced.

FIG. 9 is a photograph showing the state of a parting portion (the center and the vicinity thereof) of the resin molding. In this state of the resin molding, as compared with the cavity surface shown in FIG. 8, the rubber component in the surface resin layer is stretched like a bamboo leaf and is in a layered form. Deformation is found also in the rubber component located in a lower portion of the section and there is a residue of a molding stress.

FIG. 10 is a photograph showing the state of a parting portion (a front end) of the resin molding. In this state, the rubber component in the resin surface layer is deformed to a greater extent than the parting portion shown in FIG. 8. Further, the proportion of the rubber component located in a lower portion of the section is smaller than that of the parting portion shown in FIG. 9 and the dispersion thereof is sparse.

Such a concentration of the molding stress on the parting portion is presumed to be a cause of thin film ply separation in the surface resin layer in a state of excess heat history of the resin molding. In the surface resin layer during a resin plating process, innumerable anchor holes are formed and hydration occurs by etching, so that deterioration is unavoidable in the surface resin layer of the resin-plated product. In the hydrated layer there may occur hydrolysis of the resin due to a synergistic action between water or a slight amount of residue of a plating chemical and an excess heat history.

Thus, the blister phenomenon of the resin-plated product is a phenomenon in which the resin surface floats together with the plating film adhered thereto not due to imperfect contact between the plating film and the resin but due to ply separation of a thin resin film caused by heat history applied to the resin-plated product. That is, the floating of the plating film in the resin-plated product is attributable to the resin molding or feed resin itself, which is unavoidable in the resin plating process.

There also is a case where a problem in the manufacturing process is an obvious cause like imperfect plating-resin contact or intermetallic separation in the case of a multi-layered plating film.

Even if a problem exists in the manufacturing process, it is often misunderstood in appearance that the cause is separation or floating of a metal plating in a resin-plated product. In many cases, the true cause is not imperfect contact between resin and metal plating film, but is peeling of a thin surface resin film of a resin molding which occurs when a resin-plated product is exposed under a specific environment involving high and low temperatures and repetition thereof.

In view of this point there have been proposed plating methods for producing resin-plated products having a good plating appearance. For example, like "Method for improving the appearance of resin-plated products and products obtained by the method" described in Japanese Patent Laid Open No. 2004-300566 (Patent Literature 1), there has been proposed a method for improving the appearance of a resin-plated product, involving incorporating a solid substance other than a main component into a synthetic resin which constitutes a synthetic resin product, for the purpose of modifying or improving the synthetic resin, and forming on the resin surface fine concaves and convexes for irregular reflection of light by electrolytic nickel plating.

Patent Literature 1:
Japanese Patent Laid Open No. 2004-300566

DISCLOSURE OF THE INVENTION

Problems to be Solved by the Invention

However, according to the above appearance improving method, for producing a resin-plated product having a good plating appearance, a satin nickel plating having fine concaves and convexes is applied to a plating surface to visually cover a non-uniform appearance caused by concaves and convexes formed on the surface of a reinforced resin molding during molding or caused by concaves and convexes formed by fall-off of a reinforcing material during pre-treatment. This conventional appearance improving method involves the problem that the plating work is apt to become complicated because it is necessary to strictly control treating conditions.

Particularly, the appearance improving method in question involves the problem that it is difficult to make improvement into a good plating appearance with respect to peeling or floating of the metal plating film in the resin molding.

There also has been proposed a method wherein the whole of a resin molding is subjected to heat treatment. For example, heat treatment is performed in an electric furnace or a gas furnace for 1 to 2 hours at a temperature of 80-85° C. in the case of an ABS resin molding or 110-120° C. in the case of a PC/ABS molding. However, this heat-treating method involves the problem that concaves and convexes or deformation may occur in the resin molding because the whole of the resin molding is heated.

The present invention has been accomplished for solving the above-mentioned problems. That is, it is an object of the present invention to provide a resin plating method involving a heat-treating process as a simple additional process in resin plating and thereby such an undesirable phenomenon as a metal plating film peeling together with a thin resin film can be suppressed, which is caused by floating of a thin surface film of a resin molding.

Means for Solving the Problems

According to the present invention there is provided a resin plating method with an added heat-treating process for a resin molding, in which resin plating is performed after the resin molding is heat-treated at a high temperature.

Preferably, the resin molding is heat-treated at a high temperature so that rubber particles in the resin surface of the resin molding retain a generally circular shape.

Preferably, the resin molding is heat-treated at a high temperature so that rubber particles in the resin surface of the resin molding retain a circular shape of 2:3 or less in terms of a size ratio in longitudinal and transverse directions.

Preferably, the resin molding is heat-treated partially at a high temperature. A parting line portion of the resin molding is heat-treated at a high temperature. A specific portion of the resin molding which portion is apt to undergo peeling of a thin surface resin film of the resin molding is heat-treated at a high temperature.

The temperature of the high-temperature heat treatment is in the range from the heat deformation temperature of the resin molding to the resin molding temperature. For example, in the case where the resin molding is formed of ABS resin, it is preferable that the high-temperature heat treatment be performed in a heating temperature range corresponding to a surface temperature range of the resin molding of 80° C. to 150° C. Where the resin molding is formed of PC/ABS resin, it is preferable that the high-temperature heat treatment be performed in a heating temperature range corresponding to a surface temperature range of the resin molding of 100° to 200° C. The resin molding is heat-treated at a high temperature for a period of time in the range from 1 second to 30 minutes.

According to the above method, a residual stress remaining in the resin molding can be relaxed by heat-treating the resin molding. It is possible to prevent floating of a thin surface film of the resin molding. Consequently, it is possible to suppress the occurrence of such an undesirable phenomenon as a metal plating film after resin plating peels together with the thin resin film.

Particularly, a specific portion of the resin molding can be heat-treated in a short time without heating an uneven portion of the resin molding or a portion of the resin molding which portion is apt to be deformed. Since the resin molding can be heat-treated instantaneously even at such a high temperature as 120° or more, it is possible to relax the residual stress partially and positively.

BRIEF DESCRIPTION OF THE DRAWINGS

FIGS. 2A to 2C show the results of having actually measured temperatures applied to various portions of a resin molding with use of a thermoelectric thermometer, in which FIG. 2A is an explanatory diagram showing various portions of the resin molding, FIG. 2B is a table of first measurement results and FIG. 2C is a table of second measurement results;

FIG. 3 shows experimental results in plating and comparison made by a thermal shock test, in which the upper stage shows experimental results on resin moldings without heat treatment and the lower stage shows experimental results on resin moldings after heat treatment;

BEST MODE FOR CARRYING OUT THE INVENTION

A preferred embodiment of the present invention will be described below with reference to the drawings.

Figure 1:
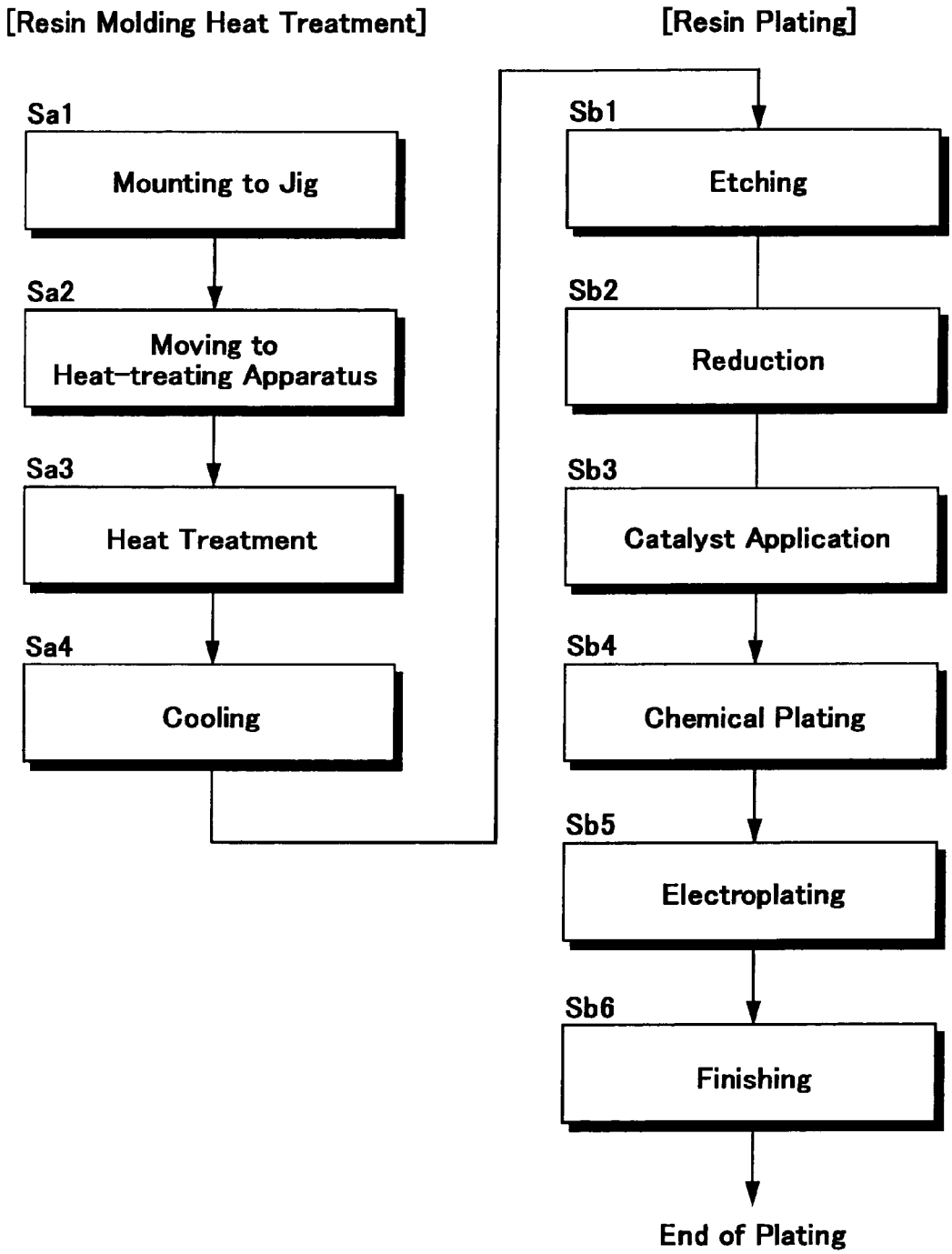
FIG. 1 is a process chart of a resin plating method involving a heat-treating process as an additional process according to the present invention.

FIG. 1 is a process chart of a resin plating method involving a heat-treating process as an additional process.

In the resin plating method of the present invention, a parting line portion of a resin molding W or a specific portion of the resin molding W which is apt to undergo peeling of a thin surface resin film is heat-treated at a high temperature (Sa1-Sa4). Next, the resin molding W thus heat-treated at a high temperature is subjected to a conventional resin plating (Sb1-Sb6). Thus, the resin plating method of the present invention comprises these two processes. This is to suppress floating of a thin surface film of the resin molding W by a high-temperature heat treatment in which floating occurs when the resin molding is exposed to a specific environment involving high and low temperatures and repetition thereof.

In the high-temperature heat-treating process, first the resin molding W is secured to a fixing jig for high-temperature heat treatment (Sa1). While moving the resin molding W within a heat-treating apparatus together with the fixing jig (Sa2), the resin molding W is heat-treated at a high temperature (Sa3).

In the resin plating process, first the resin plating (W) is subjected to such pre-treatments as etching (Sb1) and reduction (Sb2). Then, the resin molding W is subjected to catalyst treatment (Sb3) and subsequent chemical plating (Sb4). Next, electroplating (Sb5) and finishing treatment (Sb6) are performed to complete the plating process. It goes without saying that this resin plating process differs in constituent steps and treating means depending on the material and shape of the resin molding W concerned and that no limitation is made to the illustrated steps and treatments.

As the material of the resin molding W in the present invention there may be used any of all the materials used in the production of resin-plated pans, including ABS resin, PC/ABS resin (polycarbonate/ABS resin), PC/PET resin (polycarbonate/polyethylene terephthalate resin), PC/PBT (polycarbonate/polybutylene terephthalate resin), PC resin, PA resin (polyamide resin), POM resin (polyoxymethylene resin), PPE resin (polyphenylene ether resin), LCP resin (liquid crystalline polymer resin), PPS resin (polyphenylene sulfide resin), PS resin (polystyrene resin), and SPS resin (syndiotactic polystyrene resin). No limitation is made thereto. An appropriate heat treatment temperature differs depending on the resin material used. As noted in the foregoing paragraph of background art, the heating method of the present invention is effectively applicable to a resin molding W comprising two or more different resins and containing a rubbery or oil- or fat-like substance which is apt to appear in the resin molding W.

In the heating method described above, the resin molding W is partially heat-treated at a high temperature by flame heating for example. The heating method is not limited to this flame heating. There may be adopted any of all methods capable of heat-treating the resin molding W, including steam heating, heater heating, high-frequency heating, hot air heating, electromagnetic induction heating, and infrared heating.

It is preferable that the heat-treating temperature is approximately within the range from the heat deformation temperature of resin to the resin molding temperature although it differs depending on the resin material used. For example, in the case of ABS resin, it is effective to perform heat treatment in a heating temperature range corresponding to a surface temperature of the resin of 80° to 110° C. In the case of PC/ABS resin, it is effective to perform heat treatment in a heating temperature range corresponding to a surface temperature of the resin of 100° to 150° C.

The area to be heat-treated is a local area including a parting portion of the resin molding W and the vicinity thereof and a portion of the resin molding which portion is apt to undergo peeling of a thin surface resin film.

A suitable heat-treating time is in the range from 1 second to 30 minutes, but no limitation is made thereto insofar as the heat-treating time adopted does not cause such a degree of heat deformation as no longer meets the requirement as product of the resin-plated product. The heat-treating time is determined according to the quantity of heat in the heat-treating apparatus and the capacity of the resin molding to be heated. For example, when heat-treating a small resin molding W at a high temperature, the heat-treating time may be a short time, while when heat-treating a large resin molding W at a low temperature, a long heat-treating time is required.

Thus, in the present invention, the resin molding W is heat-treated partially for a short time so that a portion thereof apt to become uneven or deformed is not heat-treated. This instantaneous heating permits the treatment to be done even at such a high temperature of 120° C. or more, whereby a residual stress remaining in the resin molding W can be relaxed partially and positively. That is, the heat-treating method of the present invention treats only the stress-remaining portion of the resin molding W. Therefore, the resin-plated product obtained from this resin molding can avoid the occurrence of such undesirable phenomena as blister and peeling of the plated film.

EXAMPLE 1-1

Next, a description will be given below about experiment examples of heat-treated resin moldings according to the present invention.

Heat treatment was performed with a gas torch providing a flame temperature of about 1700° C. even at the highest in such a manner that the gas torch was spaced a sufficient distance from a resin molding to avoid melting of the resin of a parting outer periphery portion of the resin molding by direct flame.

EXAMPLE 1-2

Hot air of 180-220° C. was blown off from a nozzle having a nose diameter of 5 mm against a parting portion of a resin molding while keeping the nozzle spaced about 10-5 mm from the parting portion. About 30 cm of the outer periphery of the parting portion was heat-treated for 20-40 seconds. A grip portion of the nozzle was fixed to a work bench, then the resin molding was attached to a working NC robot and was heat-treated automatically in accordance with a working program set to 20-40 seconds while keeping the resin molding spaced 10 mm from the nozzle.

EXAMPLE 1-3

A copper pipe of about 7 mm was bent in conformity with a parting shape of product and was perforated to form 1.5 mm diameter holes at intervals of 5 mm toward a parting portion of a resin molding, thereby affording a hot air blow-off machine. With this machine, the resin molding was heat-treated by blowing off hot air for about 10-20 seconds.

Figure 2:
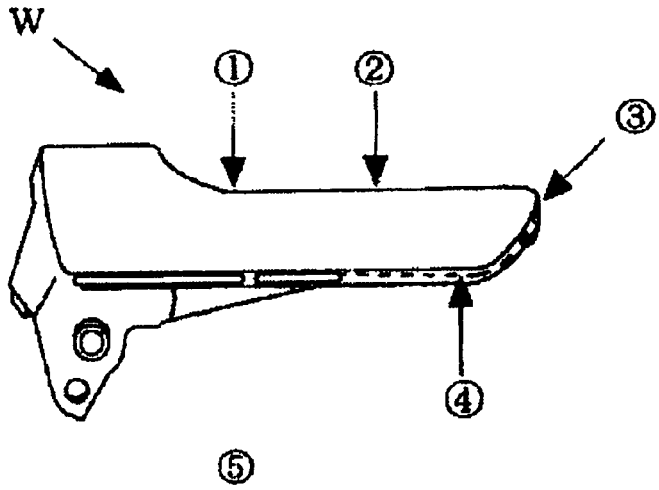

FIGS. 2A to 2C show the results of having measured temperatures applied to various portions of the resin molding, which measurement has been made using a thermoelectric thermometer. In the same figure, FIG. 2A is an explanatory diagram showing the various portions of the resin molding, FIG. 2B is a table showing the results of a first measurement, and FIG. 2C is a table showing the results of a second measurement.

EXAMPLE 1-4

With an electric heater of the same shape as the hot air nozzle used in Example 1-3, a resin molding was allowed to pass through the heater automatically and a parting portion thereof was heat-treated. The heater temperature and the resin molding passing time (heat-treating time) through the heater can be changed.

In this experiment, the resin molding was stopped for 20 seconds within the heater.

FIG. 3 shows experimental results in plating and comparison made by a thermal shock test, in which the upper stage is a table showing experimental results on resin moldings without heat treatment and the lower stage is a table showing experimental results on resin moldings after heat treatment.

The resin moldings were subjected to a conventional plating treatment and then the occurrence of an undesirable phenomenon under defined thermal shock conditions was compared with respect to the treated resin moldings and untreated resin moldings. Although the resistance to the thermal shock test somewhat differs depending on treatment conditions and methods, the parting portions of all the heat-treated resin moldings passed the thermal shock test and an extinct difference from the untreated resin moldings was confirmed.

As is seen from the tables of FIG. 3 showing experimental results, by heat-treating parting portions and edge portions of resin moldings, which portions are apt to undergo ply separation, partially at a high temperature for a short period of time, deformations and stresses of rubber components in surface resin layers remaining in those positions are diminished, whereby ply separation of thin surface resin layers caused by an excess heat history in the resin-plated products could be prevented. By the heat-treating method of the present invention, the resistance to the thermal shock test of the resin-plated products is remarkably improved. As a result, it is possible to prevent the occurrence of ply separation of a thin resin film and the simultaneous floating of the plating film both caused by the foregoing cause in a resin-plated part installed in an automobile and also possible to prevent the occurrence of a serious accident such as a driver or an occupant touching a cracked surface of a floated, plated portion and cutting his or her hand.

Figure 4:
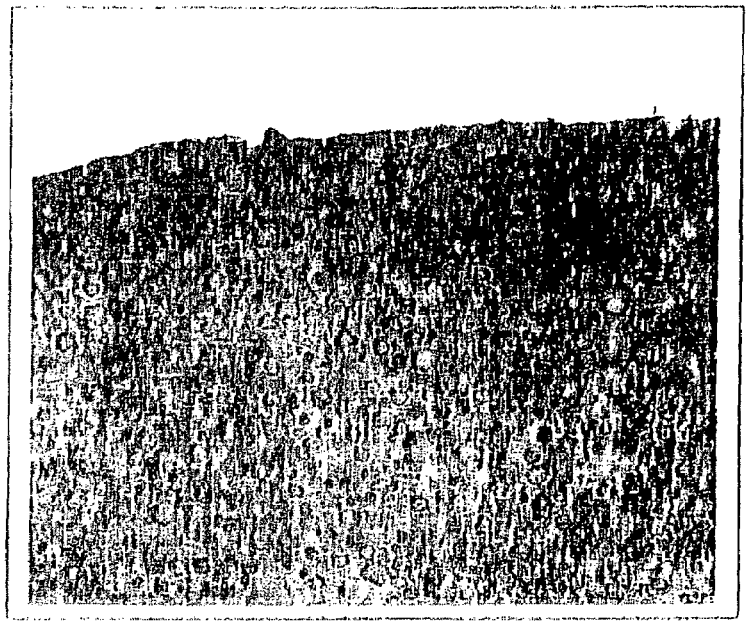
FIG. 4 is a photograph showing the state of a parting portion (the center and the vicinity) of a resin molding.
Figure 5:
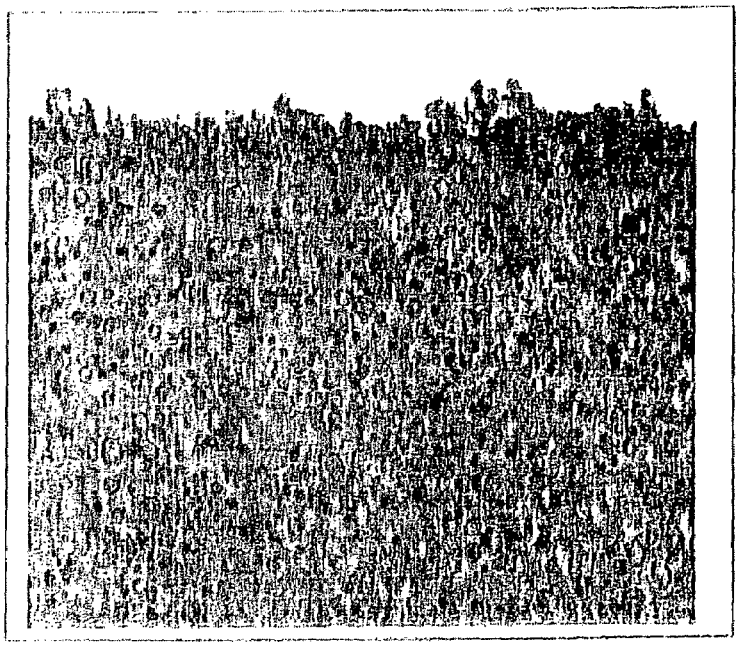
FIG. 5 is a photograph showing the state of a parting portion (a front end) of the resin molding.
Figure 6:
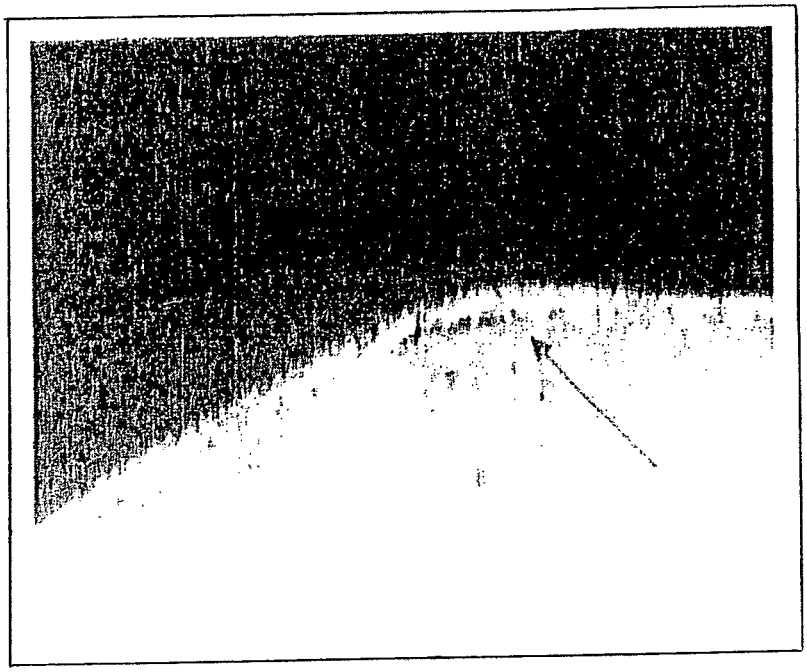
FIG. 6 is an enlarged photograph of a section of a resin-plated product in a state in which "blister" has occurred from a parting portion of the product.
Figure 7:
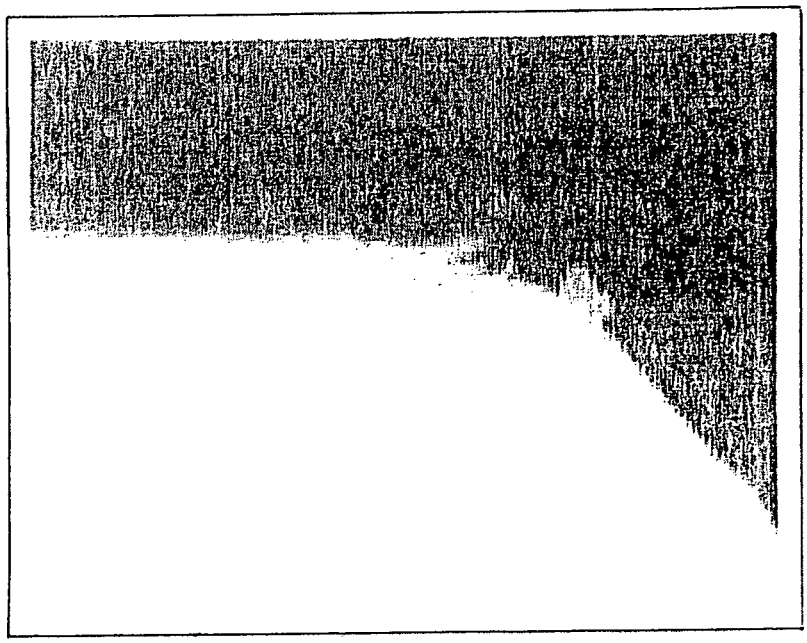
FIG. 7 is an enlarged photograph of a surface of a resin-plated product in a state in which "blister" has occurred from a parting portion of the product.

FIGS. 4 and 5 are photographs of resin surfaces taken through a transmission electron microscope (TEM), showing the effect of the partial heating for a parting portion of a resin molding heat-treated according to the present invention.

FIG. 4 is a photograph showing the state of a parting portion (the center and the vicinity) of the resin molding.

Figure 8:
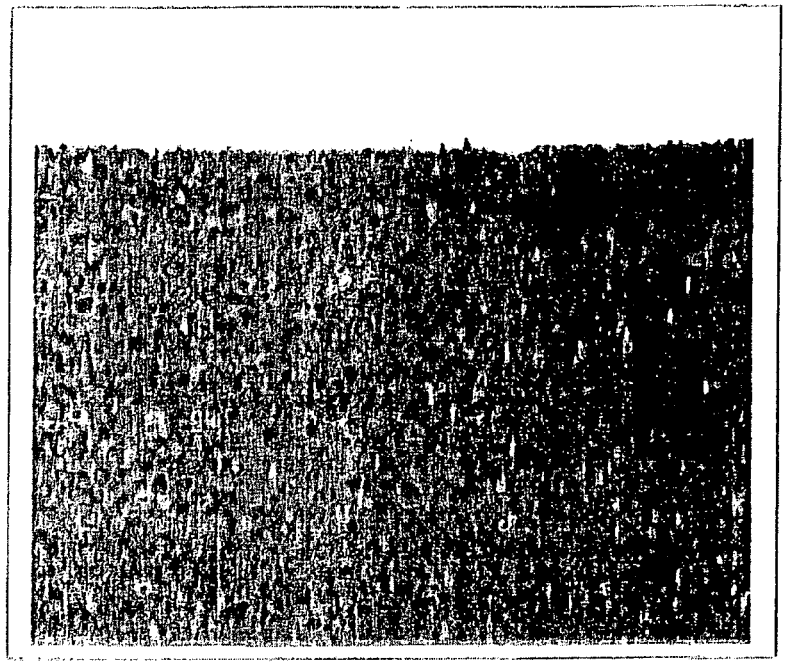
FIG. 8 is a photograph showing the state of a cavity surface (a front surface) of a resin molding.
Figure 9:
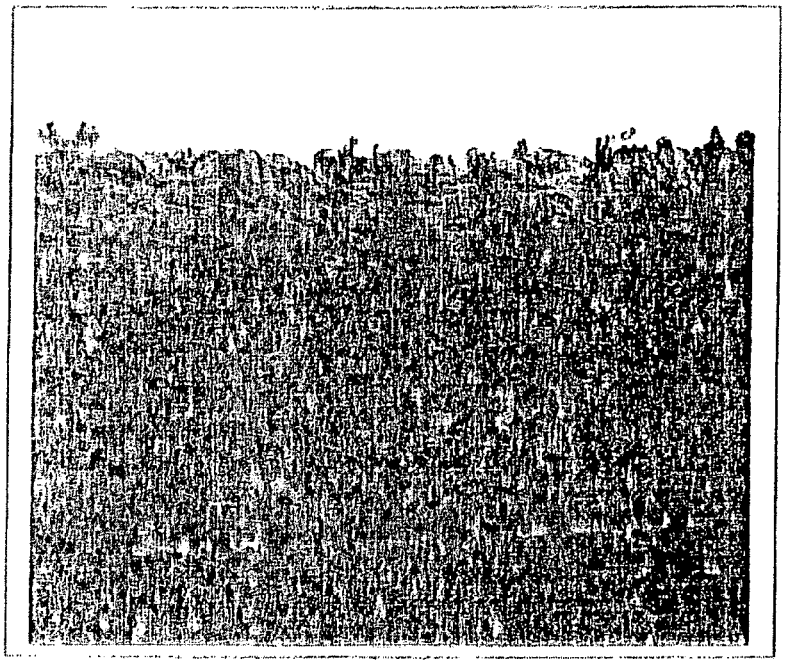
FIG. 9 is a photograph showing the state of a parting portion (the center and the vicinity) of the resin molding.
Figure 10:
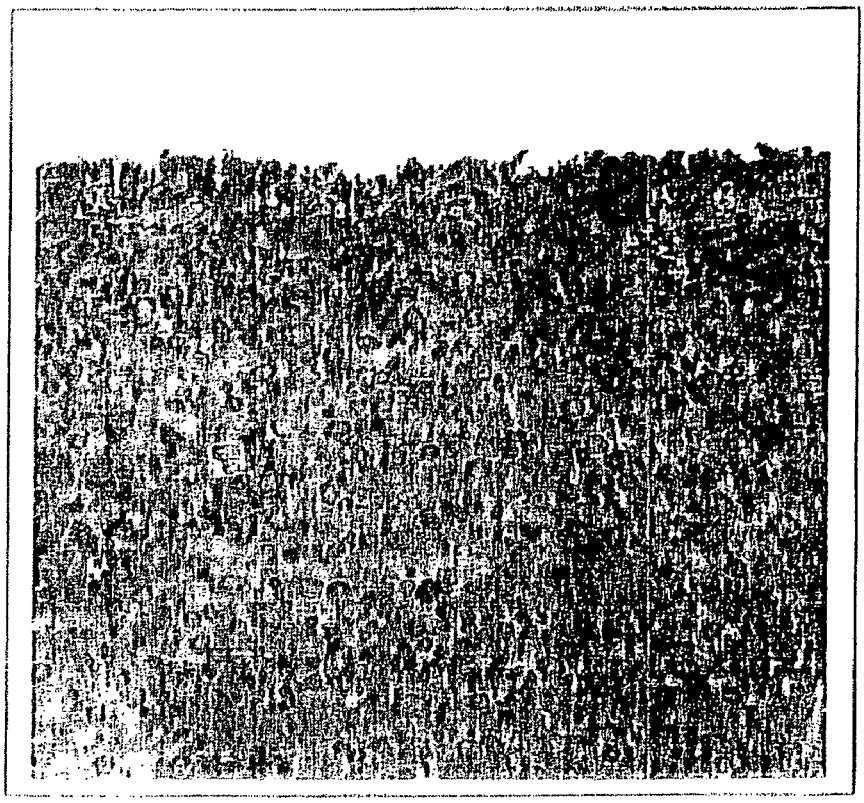
FIG. 10 is a photograph showing the state of a parting portion (a front end) of the resin molding.

As a result of having heat-treated the parting portion of the resin molding, a bamboo leaf-like rubber orientation in the surface resin layer disappeared. In the present invention, the resin molding W is subjected to a high-temperature heat treatment, whereby rubber particles in the resin surface are maintained in a generally circular shape. For example, it is preferable to perform the high-temperature heat treatment in such a manner that the rubber particles in the resin surface retain a circular shape of 2:3 or less in terms of a size ration in longitudinal and transverse directions. This clearly shows a change in state as compared with the state of the resin molding before heat treatment referred to in the foregoing paragraph of background art and illustrated in FIGS. 8 to 10. The deformation of rubber component located in a lower portion of section is also remedied. That is, it is seen that the residue of the molding stress in the parting portion has been diminished.

FIG. 5 is a photograph showing the state of a parting portion (a front end) of the resin molding.

It is seen that also in this case the deformation of rubber component in the surface resin layer is remedied. By a partial heat treatment for the parting portion of the resin molding it turned out that the molding stress imposed on the parting portion was relaxed and that the deformation of rubber component was remedied. Variations in the dispersion of rubber component in the lower portion of section are kept intact. This means that the resin molding according to the treating method of the present invention has been heat-treated on only the surface side or partially for avoiding the occurrence of an undesirable phenomenon, e.g., blister, after resin-plating without changing the physical properties peculiar to the resin molding.

As shown in FIG. 1, the resin molding plating process is completed through the steps of surface conditioning, etching (Sb1), reduction (Sb2), conditioner treatment, catalyst application (Sb3), catalyst activation, chemical plating (electroless plating) (Sb4), acid activation, electroplating (Sb5), and finishing (Sb6).

It goes without saying that the present invention is not limited to the above embodiment, but that various changes may be made within the scope not departing from the gist of the present invention insofar as the heat-treating method involves a simple additional step in resin plating and can suppress the occurrence of such an undesirable phenomenon as the metal plating film peels together with a thin resin film which is caused by floating of a thin surface film of the resin molding.

The resin plating method involving a heat-treating process as an additional process according to the present invention can be applied to door opening/closing handles or substitutes for washing metal fittings and further applicable to the treatment of resin-plated products which are frequently handled directly by hand such as, for example, electronic devices, e.g., personal computers, as well as game machines, instruments for maintaining health, and printing machines.

The invention claimed is:

1. A resin plating method with an added partial heat-treating process for plating a resin molding composed of mixture of two or more different resins in which a rubber component is dispersed, consisting of:

partially heat-treating only the parting line portion of said resin molding at a high temperature within a range from the heat deformation temperature of the resin to the resin molding temperature, and metal plating the resin molding undergoing high-temperature partial heat treating, wherein the resin molding is heat-treated at a high temperature for the rubber particles in the resin surface of the resin molding to retain a circular shape of 2:3 or less in terms of a size ratio in longitudinal and transverse directions, and wherein the resin molding is made of PC/ABS resin and the high-temperature partial heat treatment is performed within the heating temperature range to achieve surface temperature of the resin molding being between 100° C. and 200° C.

2. The resin plating method with an added partial heat-treatment process according to claim 1, wherein the heat-treating time is in the range from 10 seconds to 40 seconds.

* * * * *